United States Patent [19]

Silvestri, Jr. et al.

[11] Patent Number: 4,825,657

[45] Date of Patent: May 2, 1989

[54] APPARATUS AND METHOD FOR IMPROVED UTILIZATION OF STEAM-TO-STEAM REHEATER DRAINS

[75] Inventors: George J. Silvestri, Jr., Winter Park; Paul W. Viscovich, Longwood, both of Fla.

[73] Assignee: Westinghouse Electric Corp., Pittsburgh, Pa.

[21] Appl. No.: 149,316

[22] Filed: Jan. 28, 1988

[51] Int. Cl.[4] ..... F01K 7/38; F01K 7/22

[52] U.S. Cl. ..... 60/678; 60/679

[58] Field of Search ..... 60/678, 679

[56] References Cited

U.S. PATENT DOCUMENTS 3,930,371 1/1976 Schabert ..... 60/679 X 4,637,350 1/1987 Horibe et al. ..... 60/678 X

*Primary Examiner*—Allen M. Ostrager

*Attorney, Agent, or Firm*—F. J. Baehr, Jr.

[57] ABSTRACT

An improved method of heating feedwater streams in a steam-to-steam reheating system for turbine generators is disclosed in which a drain cooler is located to receive the reheater drain and pass it in heat exchange relationship with the discharge of the highest pressure feedwater heater. By use of the drain cooler, heat rate improvement is effected on both single stage reheat plants and two-stage reheat plants. Cycle impairment from moisture carryover in the moisture separator/reheater is also reduced.

20 Claims, 2 Drawing Sheets

APPARATUS AND METHOD FOR IMPROVED UTILIZATION OF STEAM-TO-STEAM REHEATER DRAINS

BACKGROUND OF THE INVENTION

1. Field of the Invention

This invention relates to the field of thermal efficiency in steam turbine generators. More particularly, it relates to an improved apparatus and method for utilizing steam-to-steam reheat drains.

2. Description of the Prior Art

Virtually all nuclear steam turbine generators, operating under slightly wet or low super-heated initial steam conditions , incorporate steam-to-steam reheat to improve thermal performance and reduce blade erosion. The early reheat units, for example, were single stage designs in which throttle steam was used to reheat high pressure exhaust steam that had been dried in a moisture separator. Subsequently, two-stage reheating was adapted in which the first stage, which receives the dried steam from the moisture separator, utilizes partially expanded extraction steam from the high pressure turbine element as the heating source. A second stage, which follows the first, utilizes throttle steam as the heating source.

Recent strides have been made in turbine design to include higher initial pressures and temperatures, as well as the addition of reheat features. This has brought about an increase in the number of heaters that can be justified in the turbine cycle. The increases in the fuel cost that have justified the higher pressures and temperatures for the turbine have also made it economical to design for higher outlet water temperature by including separate sections that utilize the superheat of the steam. Further, it has been found economical to include drain cooling sections in the heater that subcool the condensate after it has been condensed on the outside of the tubes to a temperature of within 6° C. (10° F.) of the entering feedwater.

In the latter 1970's, research showed that high temperature, high pressure, breeder reactor plants could also beneficially use steam-to-steam reheating and that extraction steam was the optimum steam supply for both single and two stage reheat applications.

At the present time, design practice is to discharge the drains , which are composed of a mixture of condensed steam and scavenging steam, from the high pressure reheater to the highest pressure feedwater heater. The drains from the low pressure reheater of a two-stage reheater design are discharged to either the highest pressure feedwater heater or, when there are concerns about adequate drainage, to the next lower pressure feedwater heater. The drains leaving the high pressure reheater are considerably hotter than the feedwater leaving the highest pressure feedwater heater. The difference can be as much as 55° C. (100° F.) at rated load, and in excess of 140° C. (250° F.) at 25% of rated load. Because the pressure of the reheater drains is higher than the heater extraction pressure, the drains are throttled down to the feedwater pressure prior to heat exchange. This results in a significant loss in thermal efficiency.

It has been suggested that the high pressure reheater drains be sent to a pump that would discharge to the exit of the highest pressure feedwater heater. This method, however, suffers from a major drawback in that it requires an additional pump as well as the difficulty of avoiding cavitation due to either insufficient net positive suction head (NPSH) during steady-state conditions or flashing during transients. There is the further problem of the disposal of reheating scavenging steam that is used to enhance the reheater tube bundle reliability.

Despite the advances reflected by the current state of the art, there always exists the need for new methods and apparatus to increase the thermal efficiency of steam generation systems while avoiding operational and maintenance problems. Accordingly, there exists the need for a method and apparatus that can reduce fuel costs or more efficiently utilize steam within a steam turbine generator power generation system.

SUMMARY OF THE INVENTION

This invention relates to the use of a drain cooler to receive the high pressure reheater drains of a steam-to-steam reheater system and thereby to pass the reheater drains in heat exchange relationship with condensate from the discharge of the highest pressure feedwater heater, rather than discharging reheater drains to the highest pressure feedwater heater. The use of such a drain cooler avoids the loss of thermal efficiency accompanying a throttling of the reheater drain pressure immediately prior to its discharge to the highest pressure feedwater heater. The condensate from the added drain cooler is then cascaded to the highest pressure feedwater heater.

Thus, the present invention provides a method and apparatus for improving the thermal efficiency of steam-to-steam reheating systems within steam turbine generator systems. The method and apparatus of the present invention also allows the reheater drain streams to be directly added to the feedwater stream without the need for additional pumping of the reheater drains to attain the feedwater pressure. The heat rate improvement typically becomes larger when the system is operated at less than 100% load. The invention also reduces the cycle impairment from moisture carryover in the moisture separator-reheater.

It is an object of the present invention to provide a method of improving the thermal efficiency of steam-to-steam reheater systems. It is a further object of the present invention to provide an apparatus to more efficiently heat the feedwater stream of a steam turbine generator system.

This and further objects and advantages will be apparent to those skilled in the art in connection with the detailed description of the preferred embodiments set forth below.

DETAILED DESCRIPTION OF THE PREFERRED EMBODIMENTS

Figure 1:
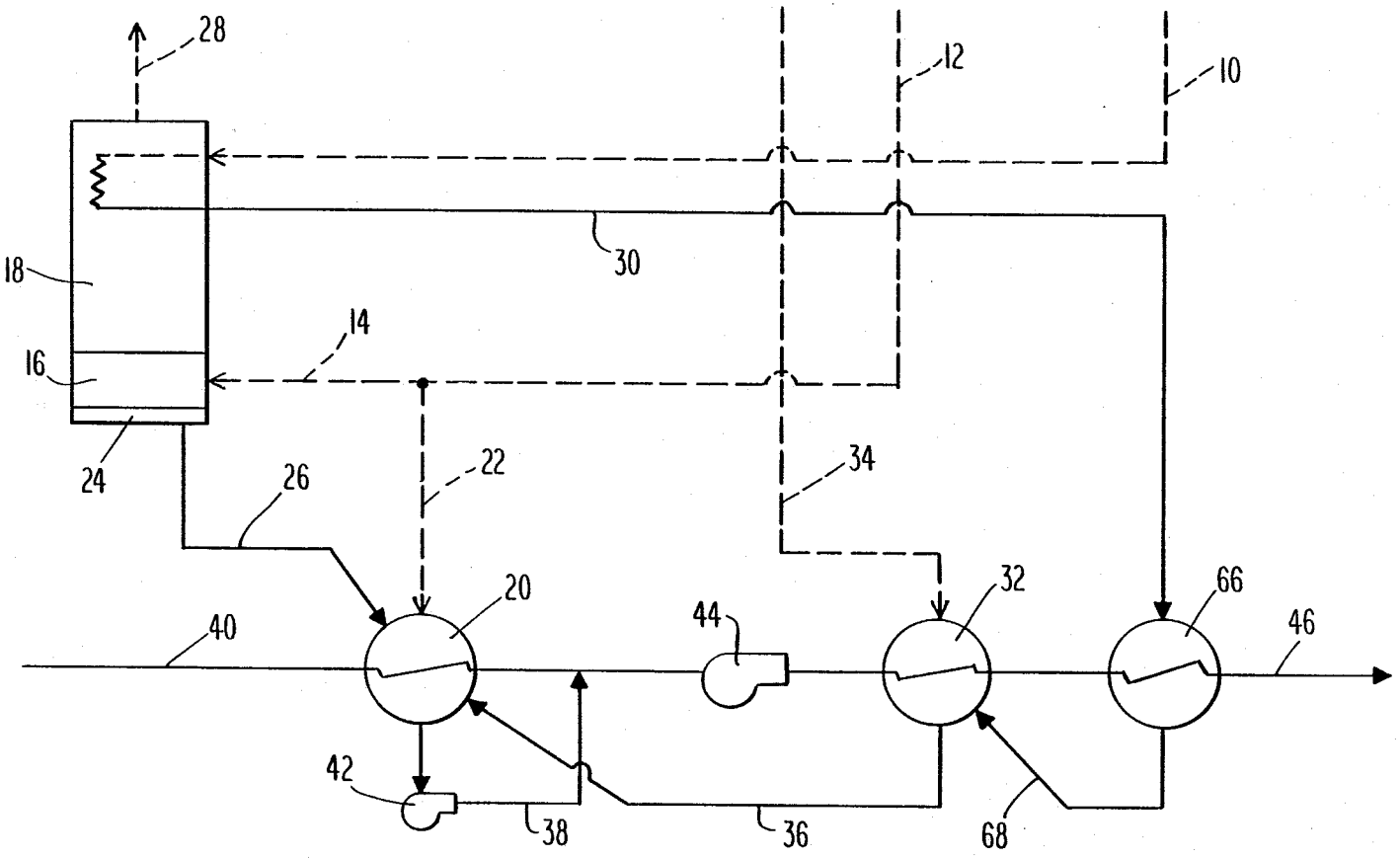
FIG. 1 is a schematic diagram illustrating a portion of a single stage reheater plant incorporating the apparatus of the present invention.

The basic type of feedwater heater is commonly referred to as a condensing heater, and is, in principle, the same as the main steam condenser in which the steam enters the shell and condenses at a constant temperature corresponding to saturation temperature for the shell pressure. The feedwater enters the heater and passes through the inside of the tubes and is heated—usually to within 3° C. (5° F.) of the saturation steam temperature. This difference between the outlet water temperature and the steam saturation temperature is normally referred to as the outlet terminal difference.

Further, almost every current central station turbine cycle includes, as an integral part of the some of the feedwater heaters, sections of the tube surface that are separated from the condensing portion of the heater and are baffled in such a way that the condensate that drains off of the condensing tubes at a temperature corresponding to saturation for the pressure and the heater shell may be collected and cooled by the incoming feedwater to within approximately 6° C. (10° F.) of its temperature. This feature has the advantage of utilizing at one higher bleed point, in the usual cycle, approximately an additional $9.28\times10_4$ J (88 BTU) from each kilogram of drains leaving the heater. This improvement means that less steam is required from that turbine bleed point to heat the feedwater to the same temperature. The addition of this drain cooling section becomes increasingly important in the lower heaters of a cycle where the drains from higher pressure heaters are cascaded to each successive lower stage pressure heater. Another advantage of using drain coolers is the reduction of condensate flashing in the drain valves and piping. In an installation where drain coolers are not used, the water drained from the heater shell will partially flash into steam as soon as its pressure drops below a value corresponding to its saturation value at the flowing drain temperature. Where drain coolers are used, this drain line pressure can be reduced to almost the pressure of the lower heater shell pressure before flashing occurs.

In any feedwater heater, one of the prime objectives is to heat the feedwater to the highest temperature possible at each turbine bleed point. Where the steam is simply allowed to enter the heater and condense on the outside of the tubes, the highest economical outlet temperature is usually about 3° C. (5° F.) below the shell saturation temperature. Where sufficient super-heat is available in the entering steam, it is possible to baffle off a portion of the tube bundle as a desuperheating section in which the leaving feedwater flows in a counter flow arrangement to the entering steam. Depending on the quantity and temperature of steam entering the heater, it is possible to have the feedwater leave the heater at, or above, the saturation temperature of the entering steam. Thus, what can be referred to as a desuperheating condensing drain cooling heater, a device having three sections, is actually no more than three separate heat exchangers operating in series that are combined in one shell to reduce cost and to conserve space.

Figure 2:
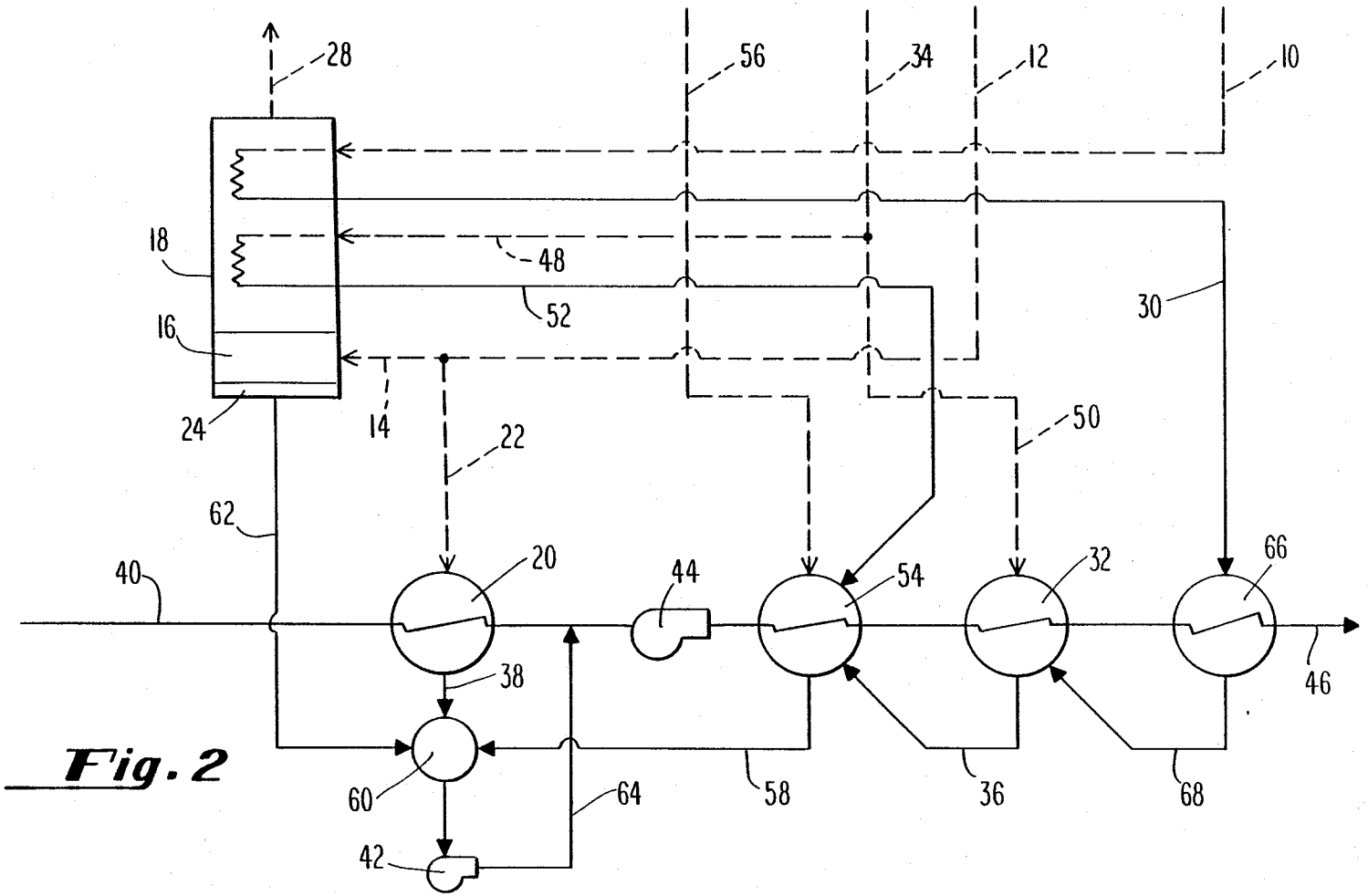
FIG. 2 is a schematic diagram illustrating a portion of a two-stage reheater plant incorporating the apparatus of the present invention.

Turning now in detail to the drawings, where like numbers refer to like items and dotted lines represent steam lines, FIGS. 1 and 2 illustrate typical examples of steam-to-steam reheat systems, of the one stage and two-stage variety, of the present invention. In a single stage reheat system of the prior art, a steam/water mixture or low superheat stream 10 is taken from the stream exiting the steam generator prior to injection into the high pressure turbine element. A high pressure exhaust steam stream 12 from the high pressure turbine element is split such that the major portion 14 is fed to a moisture separator 16 within a steam reheater 18. The remainder of the high pressure exhaust steam stream 12 is fed to a feedwater heater 20 in a stream 22. The portion of the high pressure exhaust steam stream 14 that is fed to the moisture separator 16 is substantially separated such that the majority of the liquid in that stream 14 collects in a drain tank 24 and is fed therefrom to feedwater heater 20 in stream 26. The steam portion of the separated stream 14 is reheated in the upper section of the steam reheater 18 by passing in heat exchange relationship with steam/water mixture stream 10. The reheated steam 28 can then be used for a subsequent turbine generator element. The reheater drain 30, containing predominantly condensed liquid of the steam/water mixture stream 10, is thereafter typically fed to the highest pressure feedwater heater 32. The heating side of this feedwater heater 32 is supplemented with a stream of partially expanded extraction steam 34 from the high pressure turbine element. The drain from this highest pressure feedwater heater 32 is typically cascaded to the next lower pressure feedwater heater 20 in stream 36. Often, the drain 38 from such a lower pressure feedwater heater 20 is pumped directly into the feedwater stream 40 using a small pump 42. In addition, most present feedwater heaters operate at a lower pressure that is ultimately desirable. Also, the feedwater stream 40 is typically pumped via pump 44 to a high pressure prior to entering the final feedwater heater 32, thereby ending up as a high pressure, high temperature feedwater stream 46.

In the present invention, the major elements of the single stage reheating system as described above remain essentially the same. The present invention, however, discloses discharging the reheater drain 30 from the high pressure reheater 18 to a drain cooler 66 rather than to the highest pressure feedwater heater 32. The drain 68 from the drain cooler 66 is cascaded to the highest pressure feedwater heater 32.

In FIG. 2, a similar system is described except that a two-stage reheat process is used. Thus, the stream of partially expanded extraction steam 34, that is used solely to supplement feedwater heater 32 in the single stage system, is split into two streams 48 and 50 in the two stage system. Stream 50 acts in a similar capacity to supplement feedwater heater 32. Stream 48, however, is fed to reheater 18 at a point below steam/water mixture stream 10. A second reheater drain 52 carries the mostly condensed stream resulting from the use of stream 48 for reheating purposes to the second highest pressure feedwater heater 54. This reheater 54 is supplemented by an additional, partially expanded, extraction steam stream 56 from the high pressure turbine element.

The drain 36 from the highest pressure feedwater heater 32 is, in this case, cascaded to the second highest pressure feedwater heater 54. The drain 58 from the second highest pressure feedwater heater 54 in this instance is fed to a tank 60 that receives the drain 38 from feedwater heater 20, as well as the drain 62 from the separator section 16 of reheater 18. This tank 60 helps to avoid problems of flashing within the drain system and also eases any problems resulting from flow surges. The combined drain from tank 60 is pumped via small pump 42 into the feedwater stream 40 as stream 64. In the two stage system, pump 44 typically would be used to raise the pressure of feedwater stream 40 prior to feeding that stream to the second highest pressure water heater 54. As in the single stage embodiment of the present invention discussed above, in the two-stage system, the reheater drain 30 from the high pressure reheater 18 is discharged to a drain cooler 66 rather than to the highest pressure feedwater heater 32.

By utilizing such a drain cooler 66, the reheater drain 30 is not required to be throttled down to the pressure of the highest pressure feedwater heater 32. Therefore, the temperature of the reheater drain 30 will be higher than the temperature of the feedwater leaving the highest pressure feedwater heater 32. Based on standard heat balance calculations, the log mean temperature difference (LMTD) of the drain cooler 66 will be about 17° C. (30° F.) on a single stage reheat system at rated load with a 6° C. (10° F.) drain approach temperature if the presence of the scavenging steam in the reheat drain 30 is ignored. If the temperature of the scavenging steam is considered, the LMTD will be even larger. As a result, a very small heat exchanger can be employed for drain cooler 66 whether or not the scavenging steam is considered.

The LMTD of the drain cooler 66 will be about 44° C. (80° F.) on two-stage reheating at rated load if scavenging steam is ignored. At 25% load, the LMTD is about 33° C. (60° F.) with single stage reheating and about 39° C. (70° F.) with two-stage reheating.

The method and apparatus of the present invention avoids many of the problems of the prior art. For example, prior art methods typically throttle down the pressure of reheat drain 30 prior to injection into the highest pressure feedwater heater 32. As a result of the throttling, flashing occurs within reheat drain 30 with a resultant decrease in temperature. The device of the present invention avoids this problem by utilizing the reheat drain 30 at high pressure. Use of this reheat drain 30 at high pressure substantially increases the thermodynamic efficiency of the system. By avoiding the flashing problem, resulting equipment problems from the thermal gradients and cavitation-erosion are also avoided.

The problems of reheater tube temperature cycling are also alleviated by allowing a certain portion of reheat drain 30 to be comprised of scavenging steam. Preferably, reheat drain 30 would contain at least 2% scavenging steam, with the percentage going up as the load on the system is decreased.

If scavenging steam is allowed in reheat drain 30, drain cooler 66 will preferably include a condensing section to condense this scavenging steam. It will be apparent that the proportion of drain cooler 66 allotted to condensing versus drain cooling will vary depending upon the amount of scavenging steam allowed in reheat drain 30.

Heat balance calculations have been made on both single and two-stage reheating applications and are shown in Tables I and II below. In these calculations, the amount of scavenging steam was held at 2% from full load to 25% load in one instance, and was varied inversely with load in another instance using standard curves. In the latter instance, scavenging steam increased to about 21% at 25% load.

These heat balance calculations were made with constant throttle pressure at all loads. In reality, however, the throttle pressure will increase as load decreases. This would increase the cycle improvement of the present invention because the base case (standard cycle) would have a poorer relative heat rate than is shown in the comparison in Tables I and II, below. Moreover, the LMTD, would increase at low load.

TABLE I

| Single Stage Reheat Performance Comparison | | | | | |
|---|---|---|---|---|---|
| | | Heat Rate, KJ/Kw-hr (BTU/Kw-hr) | | Heat Rise Across Drain Cooler | |
| Load % | Scav. Steam % | Std. Cycle | Prop. Cycle | °C. | °F. |
| 100 | 2.0 | 10172 (9642) | 10149 (9620) | 5.1 | 9.1 |
| 75 | 2.0 | 10111 (9584) | 10077 (9552) | 7.8 | 14.0 |
| 50 | 2.0 | 10587 (10035) | 10524 (9975) | 11.3 | 20.4 |
| 25 | 2.0 | 11851 (11233) | 11728 (11117) | 17.3 | 31.1 |
| 100 | 2.1 | 10172 (9642) | 10149 (9620) | 5.1 | 9.2 |
| 75 | 4.5 | 10115 (9588) | 10077 (9552) | 8.7 | 15.7 |
| 50 | 8.9 | 10609 (10056) | 10525 (9977) | 14.4 | 25.9 |
| 25 | 20.6 | 11946 (11323) | 11731 (11119) | 27.4 | 49.4 |

TABLE II

| Two Stage Reheat Performance Comparison | | | | | |
|---|---|---|---|---|---|
| | | Heat Rate, KJ/Kw-hr (BTU/Kw-hr) | | Heat Rise Across Drain Cooler | |
| Load % | Scav. Steam % | Std. Cycle | Prop. Cycle | °C. | °F. |
| 100 | 2.0 | 10144 (9615) | 10132 (9604) | 3.2 | 5.8 |
| 75 | 2.0 | 10081 (9555) | 10057 (9533) | 5.7 | 10.2 |
| 50 | 2.0 | 10555 (10005) | 10505 (9957) | 9.1 | 16.4 |
| 25 | 2.0 | 11832 (11215) | 11735 (11123) | 15.2 | 27.4 |
| 100 | 2.1 | 10145 (9616) | 10132 (9604) | 3.2 | 5.8 |
| 75 | 4.5 | 10085 (9559) | 10057 (9533) | 6.3 | 11.3 |
| 50 | 8.9 | 10570 (10019) | 10506 (9958) | 11.6 | 20.8 |
| 25 | 20.7 | 11914 (11293) | 11737 (11125) | 24.2 | 43.6 |

It can be seen that an increase in scavenging steam has only a minor effect on the heat rate of the proposed cycle (a maximum of two Kilojoules/kw-hr) but a large effect on the heat rate of the standard cycle. This also indicates that the effect of moisture carry-over from the separator, i.e., inefficient separation resulting in increased liquid to be passed to the reheater, which increases the steam requirement of the reheater, would be less severe with the proposed cycle. It has been verified that an additional improvement occurs that is three to four Kilojoules/kw-hr at 75% load, six to eight Kilojoules/kw-hr at 50% load, and 18 to 19 Kilojoules/kw-hr at 20% load (using a 1% moisture carryover).

As mentioned above, the design of the drain cooler 66 would include a condensing section because of the presence of scavenging steam as well as the drain cooling section for the condensed water from the reheater and the condensed scavenging steam from the condensing section. Disposition of the reheater drain 30, and, in a two-stage system, reheater drain 52, would be simplified as compared to the standard practice that requires an erosion-resistant pressure breakdown device to dissipate the excess pressure of the steam/water mixture of the reheater drains.

Use of the device of the present invention may result in a final feedwater temperature slightly above optimal.

However, such a result is outweighed by the increase in heat rate efficiency. In other cases, where initial design has established a final feedwater temperature slightly below optimal in order to minimize the cost of capital equipment, the device of the present invention will raise up the final temperature to the optimum. If a new system was being designed, it would be preferable to design the system in order to obtain the same final feedwater temperature as obtained under previous designs. This, of course, would necessitate some redesigning of previous stage heat exchangers.

As just discussed, a major advantage of the present invention is that it can be used to improve the thermal efficiency of existing plants. Existing plants could be backfitted with the additional drain cooler of the present invention. On new units, the pressure at the highest extraction would be lowered so that the temperature leaving the drain cooler would be at the desired value.

The method and apparatus of the present invention exhibit several other distinct advantages over the prior art. The present invention obtains more power for the same amount of Kilojoules (BTU's) with respect to the thermal output rating. This results from the fact that the present invention reduces energy dissipation within the system. In addition, the system of the present invention is generally more tolerant of problems that may occur within the cycle such as varying amounts of scavenging steam and moisture carry-over from the separator 16, as discussed above.

In previous steam-to-steam reheat systems, an additional pump was required to increase the pressure of the feedwater heater drain streams if they were ultimately to be added to the feedwater stream. In the method of the present invention, however, such a pump becomes unnecessary.

Finally, current methods typically have high pressure liquid feeding with lower pressure steam into the heat exchangers. This leads to a violent expansion/flashing of the liquid with resultant equipment problems. The method of the present invention, on the other hand, cools the reheat drain 30 in the drain cooler 66 and, thereby, avoids many of these problems once the resultant stream 68 is fed to the highest pressure feedwater heater 32.

The primary basis of the present invention is to utilize system energy at maximum pressure, thereby promoting thermal and system efficiency.

Having thus described the invention, it is to be understood that the invention is not limited to the embodiments set forth herein for purposes of exemplification, but is to be limited only by the scope of the attached claims, including a full range of equivalents to which each element thereof is entitled.

I claim as my invention:

1. In a steam turbine generator employing steam-to-steam reheating having a reheater with a reheating drain and having several feedwater heaters connected in series to heat feedwater of increasing pressure, each of said feedwater heaters having a feed inlet and a feed outlet, the improvement comprising:

a drain cooler receiving the reheating drain from the reheater and passing said reheating drain in heat exchange relationship with the feed outlet of said feedwater heater having the highest pressure prior to feeding said reheating drain to said feedwater heater having the highest pressure.

2. The steam turbine generator of claim 1 wherein the reheater is a two stage reheater, each stage having a reheating drain, and the drain cooler receives the reheating drain from the second of said two stages.

3. The steam turbine generator of claim 1 wherein the pressure of the reheating drain from the reheater remains substantially the same when it is fed to the drain cooler.

4. The steam turbine generator of claim 1 wherein the reheating drain from the reheater contains steam.

5. The steam turbine generator of claim 4 wherein the drain cooler contains a condensing section to condense said steam.

6. A steam turbine generator employing steam-to-steam reheating having a reheater with a reheating drain and having several feedwater heaters connected in series to heat feedwater of increasing pressure, each of said feedwater heaters having a feed inlet and a feed outlet, and further comprising:

a drain cooler receiving the reheating drain from the reheater and passing said reheating drain in heat exchange relationship with the feed outlet of said feedwater heater having the highest pressure prior to feeding said reheating drain to said feedwater heater having the highest pressure.

7. The steam turbine generator of claim 6 wherein the reheater is a two stage reheater, each stage having a reheating drain, and the drain cooler receives the reheating drain from the second of said two stages.

8. The steam turbine generator of claim 6 wherein the pressure of the reheating drain from the reheater remains substantially the same when it is fed to the drain cooler.

9. The steam turbine generator of claim 6 wherein the reheating drain from the reheater contains steam.

10. The steam turbine generator of claim 9 wherein the drain cooler contains a condensing section to condense said steam.

11. An improved method of heating feedwater in a steam turbine generator employing steam-to-steam reheating and having a reheater with a reheating drain and having several feedwater heaters connected in series to heat feedwater of increasing pressure, each of aid feedwater heaters having a feed inlet and a feed outlet, comprising:

using a drain cooler to receive the reheating drain from the reheater and to pass said reheating drain in heat exchange relationship with the feed outlet of said feedwater heater having the highest pressure prior to feeding said reheating drain to said feedwater heater having the highest pressure.

12. The method of claim 11 Wherein the reheater is a two stage reheater, each stage having a reheating drain, and the drain cooler receives the reheating drain from the second of said two stages.

13. The method of claim 11 wherein the pressure of the reheating drain from the reheater remains substantially the same when it is fed to the drain cooler.

14. The method of claim 11 wherein the reheating drain from the reheater contains steam.

15. The method of claim 14 wherein the drain cooler contains a condensing section to condense said steam.

16. A method of improving the thermal efficiency of an existing steam turbine generator employing steam-to-steam reheating and having a reheater with a reheating drain and having several feedwater heaters connected in series to heat feedwater of increasing pressure, each of said feedwater heaters having a feed inlet and a feed outlet, comprising:

backfitting a drain cooler to receive the reheating drain from the reheater and to pass said reheating drain in heat exchange relationship with the feed outlet of said feedwater heater having the highest pressure prior to feeding said reheating drain to said feedwater heater having the highest pressure.

17. The method of claim 16 wherein the reheater is a two stage reheater, each stage having a reheating drain, and the drain cooler receives the reheating drain from the second of said two stages.

18. The method of claim 16 wherein the pressure of the reheating drain from the reheater remains substantially the same when it is fed to the drain cooler.

19. The method of claim 16 wherein the reheating drain from the reheater contains steam.

20. The method of claim 19 wherein the drain cooler contains a condensing section to condense said steam.

* * * * *